US006877196B2

(12) United States Patent
Oathout et al.

(10) Patent No.: US 6,877,196 B2
(45) Date of Patent: Apr. 12, 2005

(54) PROCESS AND APPARATUS FOR INCREASING THE ISOTROPY IN NONWOVEN FABRICS

(75) Inventors: James Marshall Oathout, Mount Juliet, TN (US); Phillip O. Staples, Nashville, TN (US); Donald Floyd Miller, Hendersonville, TN (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 213 days.

(21) Appl. No.: 09/922,048

(22) Filed: Aug. 3, 2001

(65) Prior Publication Data

US 2002/0116801 A1 Aug. 29, 2002

Related U.S. Application Data

(60) Provisional application No. 60/223,043, filed on Aug. 4, 2000.

(51) Int. Cl.[7] ..... D04H 1/46

(52) U.S. Cl. ..... 28/104; 28/167

(58) Field of Search ..... 28/103, 104, 105, 28/106, 167, 163; 68/200, 205 R, 201; 239/548, 554, 556, 557, 560, 566, 567

(56) References Cited

U.S. PATENT DOCUMENTS

| | | | | | |
|---|---|---|---|---|---|
| 2,665,189 | A | * | 1/1954 | Cox | 8/156 |
| 3,353,225 | A | * | 11/1967 | Dodson, Jr. et al. | 28/104 |
| 3,485,706 | A | | 12/1969 | Evans | |
| 3,560,326 | A | * | 2/1971 | Bunting, Jr. et al. | 442/408 |
| 3,747,161 | A | | 7/1973 | Kalwaites | |
| 3,873,255 | A | * | 3/1975 | Kalwaites | 28/104 |
| 4,228,123 | A | * | 10/1980 | Marshall | 264/557 |
| 4,691,417 | A | * | 9/1987 | Vuillaume | 28/105 |
| 4,693,922 | A | | 9/1987 | Buyofsky et al. | |
| 4,960,630 | A | | 10/1990 | Greenway et al. | |
| 4,991,264 | A | | 2/1991 | Greenway et al. | |
| 5,005,272 | A | * | 4/1991 | Severinsen | 26/106 |
| 5,235,733 | A | * | 8/1993 | Willbanks et al. | 28/105 |
| 5,491,857 | A | * | 2/1996 | Love et al. | 8/151 |
| 5,632,072 | A | | 5/1997 | Simon et al. | |
| 5,737,813 | A | * | 4/1998 | Sternlieb et al. | 28/167 |
| 5,806,155 | A | * | 9/1998 | Malaney et al. | 28/167 |
| 6,253,429 | B1 | * | 7/2001 | Zolin | 28/104 |
| 6,295,706 | B1 | * | 10/2001 | Strahm | 28/167 |
| 6,442,810 | B2 | * | 9/2002 | Greenway et al. | 28/104 |
| 6,546,605 | B1 | * | 4/2003 | Emery et al. | 28/167 |
| 6,571,441 | B1 | * | 6/2003 | Kobayashi et al. | 28/104 |
| 2003/0101558 | A1 | * | 6/2003 | Sternlieb et al. | 28/167 |

FOREIGN PATENT DOCUMENTS

| | | | | |
|---|---|---|---|---|
| CA | 739652 | * | 8/1966 | |
| EP | 0337451 | A2 | 10/1989 | |
| EP | 0351949 | A2 | 1/1990 | |
| EP | 1036872 | A1 | 9/2000 | |
| RU | 432934 | * | 6/1974 | 28/104 |
| WO | WO 90/04066 | A2 | 4/1990 | |

* cited by examiner

*Primary Examiner*—Amy B. Vanatta

(57) ABSTRACT

A method for changing the position of fibers in a nonwoven web to improve the isotropy of the web by using angled stream of fluid wherein the streams form a substantially coplanar curtain and impinge on the fibers at their leading ends, trailing ends or sides.

1 Claim, 4 Drawing Sheets

PROCESS AND APPARATUS FOR INCREASING THE ISOTROPY IN NONWOVEN FABRICS

BACKGROUND OF THE INVENTION

1. Field of the Invention

This invention relates to decreasing the anisotropy of nonwoven materials and particularly spunlaced nonwovens.

2. Description of Related Art

In the manufacture of nonwoven fabrics, it is common to experience anisotropic properties. Probably the most important property is tensile strength of the fabric, wherein the strength in the "machine-direction" (MD) is notably higher than that in the "cross-machine-direction" (XD). This MD/XD ratio of strength, typically greater than unity, is a disadvantage versus other fabrics such as woven goods where the strengths are relatively balanced. In nonwovens, this MD/XD ratio is often at least 2:1. It is often higher in the case of fabrics made from carded web substrates where the ratio can approach 4:1 or even 5:1. Even spunbonded fabrics exhibit this same imbalance of properties, which is exacerbated by high laydown speeds.

Attempts to control or reduce this ratio by conventional means include cross-lapping of air-laid or carded webs, stretching a formed fabric in the XD direction, or the use of a "scrambler" roll after a card doffer roll. In the case of spunbonded fabrics, such as Typar®, available from E.I. du Pont de Nemours and Company, Wilmington, Del. (hereafter DuPont), curtains of fibers are oscillated with rotary air jets in both the MD or XD direction. To achieve balanced properties, fibers must be oriented in the direction of the desired strength. The relatively small number of fibers in the cross machine direction in contrast to the larger number in the machine direction corresponds to the relatively lower XD strength.

SUMMARY OF THE INVENTION

This invention is a method for changing the orientation of fibers in a nonwoven web wherein a portion of the fibers are oriented in substantially the machine direction and a portion of the fibers are oriented in substantially the cross-machine direction comprising the steps of providing a plurality of fluid jets offset at an appreciable angle from the perpendicular with respect to the web, applying a stream of fluid from the jets onto a surface of the nonwoven web at a pressure sufficient to move the fibers into a different orientation wherein the streams form a substantially coplanar curtain, locking the moved fibers of the nonwoven web to maintain the different orientation of the fibers of the nonwoven web.

DETAILED DESCRIPTION OF THE INVENTION

The instant invention is a method to perturb fibers already laid on a belt with jets (or streams) of fluid, typically water, angled to the belt. Herein, angled means that the main axis of a jet is at an angle of at least about 10° from the vertical. This jet, located early in a hydroentangling process (wherein the fibers are still mobile) perturbs the fiber ends in a more-cross-machine direction where they are subsequently entangled with other fibers. Without being held to any specific theory, it is believed that the final form of such perturbed fibers could be S-shaped, Z-shaped, curved such as in a C-shape, or variants thereof. This fiber deformation has been confirmed through the use of black tracer threads laid atop the web before perturbation and entanglement. It is noted here that perturb means to move fibers or sections of fiber from one position or orientation to a different position or orientation and can further include changing the shape of such fibers.

The perturbing jet can be of normal, straight (i.e., non-angled) manufacture; i.e., its main axis would be vertical when mounted in a jet housing or body. Such arrangements are typical for hydroentangling processes wherein it is intended that the jet of water travels perpendicularly to the fiber web. Such a normal jet can be mounted in a jet body which is angled relative to the unbonded fabric web and as such the jet of water would travel at the same angle. That is, the fluid could be directed onto the leading ends or against the trailing ends of fibers which would perturb the fiber ends into a more XD-orientation.

Figure 1B:
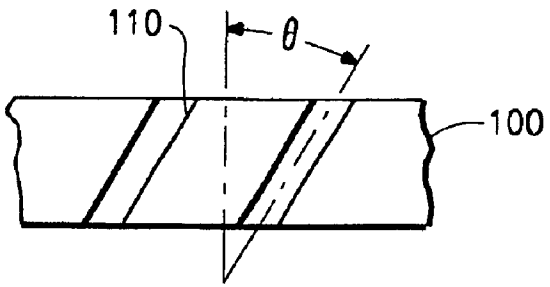
FIGS. 1 and 1B are schematic sketches of a jet strip with angled holes.
Figure 1:
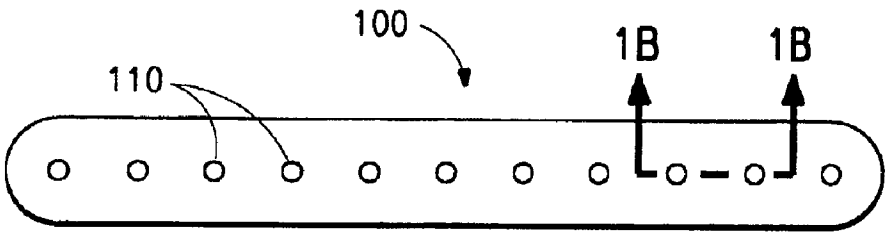

As a point of clarification, the term jet strip will be used to refer to a distribution device that provides a passageway for the specifically sized streams of fluid and the angle at which the streams of fluid are directed. A simple jet strip 100 is depicted schematically in FIG 1. The holes 110 in the jet strip are typically small and closely spaced. Depending on context, the term jets may refer to the holes in the jets strip or the streams that issue from the jet strip. Although holes 110 in the jet strip are shown as angled downward from left to right it is understood that the holes could also be angled from right to left or front to back or back to front within the jet strip 100. Also, the terms jet body or jet housing will be used to refer to a device that holds the jet strip and that can be rotated about its major axis to provide for delivery of streams of fluid at different angles. Moreover, a combination of jet strips with angled holes and rotated jet housing can provide fluid streams at many different angles and directions. Typically the holes in the jet strips are arranged in rows as generally shown in FIG. 1 and provide for passage of fluid so that the streams are substantially coplanar. When the fluids are liquids, the closely spaced holes in the jet strip provides what amounts to a "curtain" or "wall" of the liquid as depicted, for example, as element 11 in FIG 2.

Figure 2:
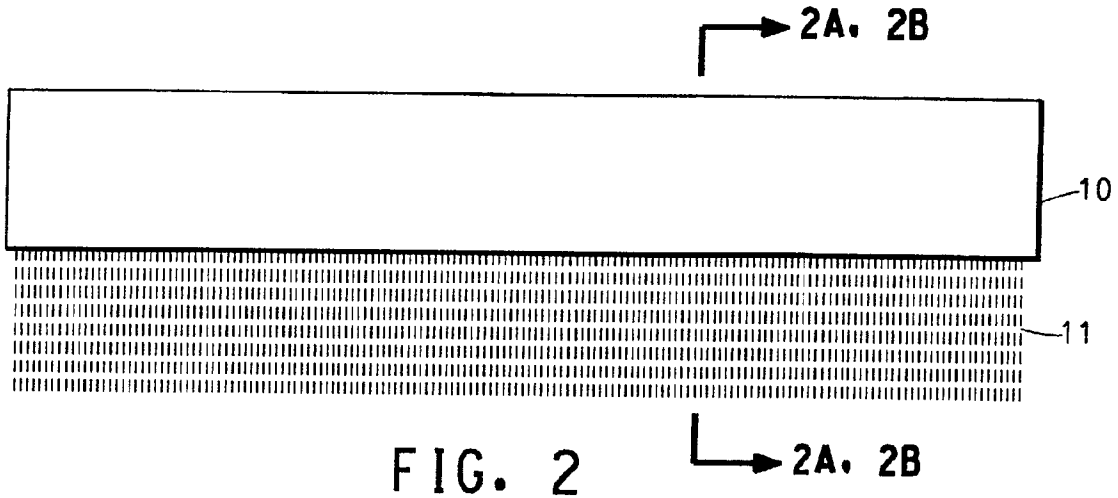
FIGS. 2–2B are schematic diagrams showing views of a jet housing and possible arrangements of a single curtain of fluid streams.
Figure 2B:
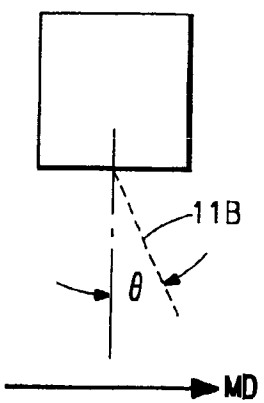
Figure 2A:
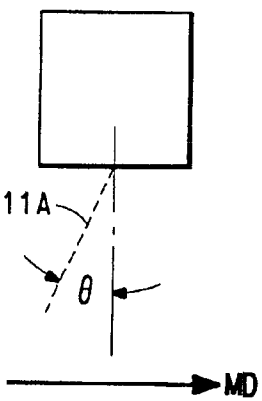

An embodiment for practicing the invention is depicted in FIG. 2, wherein a curtain 11 is depicted as issuing from a housing 10. A jet strip with a plurality of holes, although not shown would be incorporated in the housing 10. FIGS. 2A an 2B show alternatives of having the curtains 11A or 11B arranged at some angle so that the streams impact either the leading ends or trailing ends of fibers, respectively, with such fibers oriented substantially in the machine direction.

Figure 3:
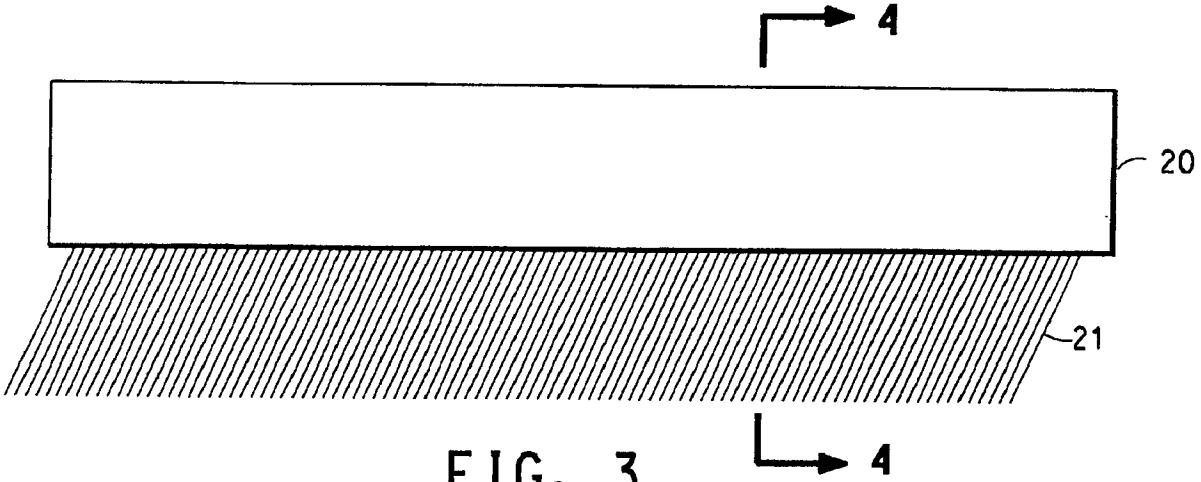
FIGS. 3–4 are schematic diagrams showing views of a jet housing and different arrangements single curtain of fluid streams.
Figure 4:
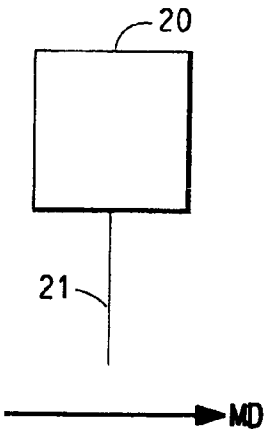
Figure 3A:
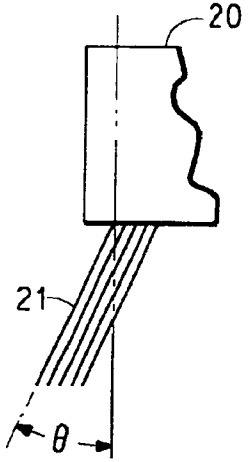

The jet strips or jet bodies can be arranged in various ways to achieve the desired perturbation of the fibers in the webs. FIGS. 3 and 4 show an embodiment where a curtain 21, which is oriented at an angle θ from the vertical and directed towards an edge of the web. However, even though the curtain 21 is directed toward an edge of the web, this embodiment provides that the curtain 21 is substantially perpendicular to the web when viewed parallel to the XD as shown in FIG. 4. In this embodiment, the streams of fluid comprising the curtain would impart a sidewise perturbation to those fibers in the unconsolidated web.

Figure 5:
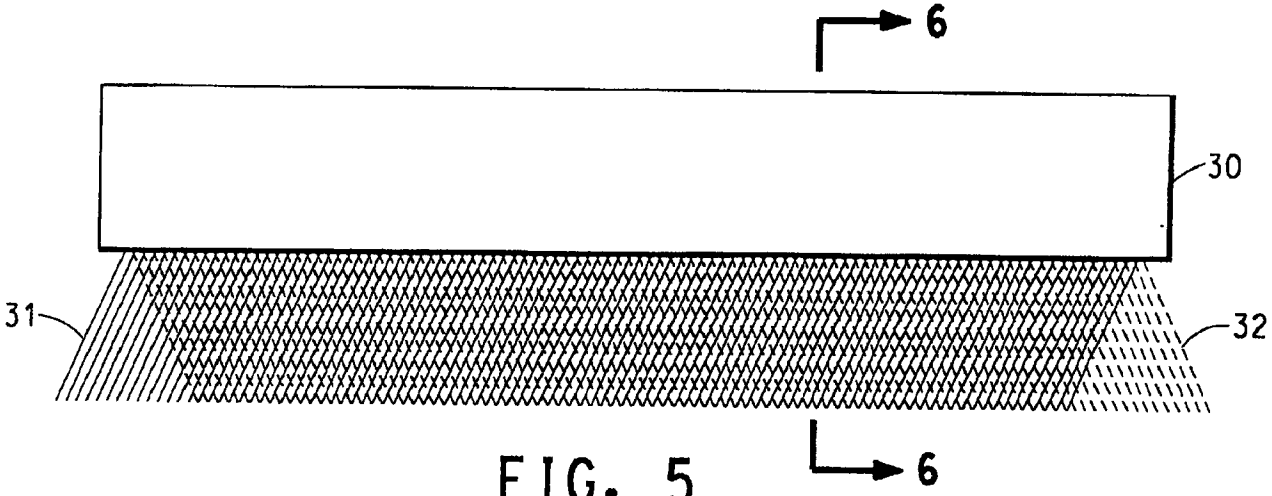
FIGS. 5–6 are schematic diagrams showing views of a jet housing and arrangements of plural curtains of fluid streams.
Figure 6:
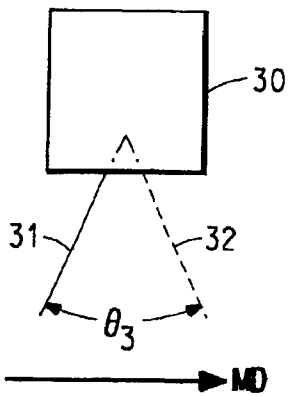
Figure 5A:
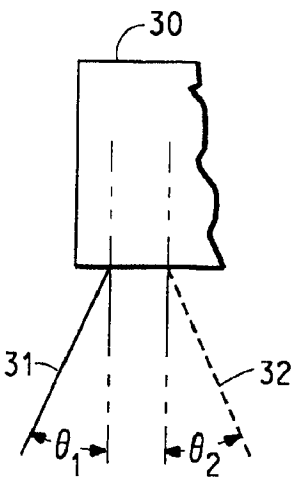

In yet another embodiment, curtains can be used either in single or double row configuration that incorporate compound angles. As shown in FIGS. 5–5A, a housing 30 can provide curtains 31 and 32 at an angle $\theta_1$ or $\theta_2$, respectively, both directed towards the sides of the web. As shown in FIG. 6, the curtains 31 and 32 are also splayed relative to each other at angle $\theta_3$ towards either the front or rear end of the web. Although not shown In FIG. 6, it is understood that the curtains 31 and 32 would issue from at least one jet strip having one or more rows of angled holes. As such, in such an arrangement, the streams comprising the combination curtains 31 and 32 would perturb the sides of those fibers as well as the trailing ends and leading ends of the fibers.

Much of the development of the subject invention was performed on a laboratory scale table washer that would allow relaxation of the perturbed fibers (due to resetting the belt position) before entangling steps which are performed as batch processes. It was found that even greater improvement could be seen on a fill scale commercial lines, where the hydroentangling will take place in-line immediately after perturbation.

It is also believed that pulsating jets of fluid may be used to produce discontinuous perturbation of fibers, that spray nozzles of liquid or air may be used instead of conventional jet technology, such as described in U.S. Pat. No. 3,485,706 to Evans. Air jets can be used in dry areas, where the introduction of liquid would be deleterious to the product or process. For example, air could be used even when making certain styles of Sontara® products (available from DuPont) having a cellulose addition and where no consolidator jets are present. The fiber can be perturbed with air jets onto a carded web before the cellulose addition.

The perturbing operation is preferably conducted at relatively low pressures compared to the pressures typically used in hydroentangled products, such as Sontara.

Although typically one jet housing was used, a greater number could be used to achieve the desired perturbation, without any loss in isotropy.

The jet height was defined as the distance from the bottom of the jet body to the upper surface of the belt on which the web is supported. The jet height could vary between about 10 and 55 mm, with 25 mm as a preferred jet height.

In addition to applicability to air-laid or card-fed nonwovens, the concept should also find utility in resin-bonded and thermal bonded nonwovens, needlepunched fabrics, and, perhaps to a lesser extent, to spunbonded fabrics if perturbation is done before bonding, when the fibers can still be moved. The perturbed webs need to be subjected to some means for "locking in" the fibers in their new orientation to maintain the improved isotropy of the webs. Depending on how the nonwoven web was made, the locking in step can be hydroentangling or some type of bonding step that would preclude the perturbed fibers from reverting to their original position or orientation.

EXAMPLES 1–17

The fabrics described here were made on a table washer at 40 yards per minute (ypm) unless otherwise noted, using a jet profile (after fiber perturbation and consolidation) as shown below for each set of examples. Varying degrees of angled jet perturbation were imparted to the webs. The inventive jet strip was located at jet position #1 (normally occupied by a consolidator jet in certain commercial hydroentangling lines). The jet strip had 10 jet holes/inch with a diameter of 13.5 mils drilled at a 30° angle to the vertical and the holes were directed toward one side of the web. Pressure for the perturbation ranged from less than about 40 psi to 200 psi.

In all cases, subsequent to the initial perturbation, the webs were hydroentangled with about 10 milli-HP-hr-$lb_{force}/lb_{mass}$, (known in common parlance as 10 IxE) to represent each of the belt and drum entanglement stations. The jet profile is representative of a "belt" and "drum" entanglement system as found on some commercial scale hydroentangling lines. A single 5/40 jet (40 holes per inch of 5 mil diameter) was used, and multiple passes in the same direction of travel were made, adjusting pressure as indicated to simulate a series of different jets as would be experienced in a commercial scale line.

Except as otherwise indicated, all of the examples provided below utilized webs of 100% polyester fiber. Similar results would be expected with other fibers, either in unblended form, or blended with other staple fibers, synthetic or not. Such webs can be composed of all rayon, lyocell, nylon, polypropylene, cotton, and other natural or synthetic fibers; as well as from blends of polyester and lyocell; polyester and rayon; polyester and polypropylene; and all combinations thereof.

In these examples and throughout the specification, the fabric strength will be presented as "sheet grab tensile" (SGT) measurements taken in the machine direction (MD) and the cross-machine direction (XD). The SGT test is performed according to ASTM D5034 (latest edition 1995) "Standard Test Method for Breaking Strength and Elongation of Textile Fabrics (Grab Test)".

Control samples are designated by capital letters and working examples are designated by number.

EXAMPLES 1–2

Fabric samples were formed from "Rando-carded" web (manufactured on a Rando-Webber) of about 2 oz/yd$^2$ basis weight and having a denier per filament (dpf) of 1.35 and a length of about 0.8 inches. There were two controls and two working examples. The jet profile used was as follows:

Initial fabric side after consolidation (Belt) (psi): 500, 1000, 1300, 1500, 1500, 1000, 1000

Second fabric side, after belt (Drum) (psi):500, 1500, 1500, 1500, 1500, 1000.

TABLE 1

| Sample | Before Belt Perturb jet # passes pres. & consol. | MD SGT, lbs. | XD SGT, lbs | MD/XD SGT | Avg. Strength, lbs | Comment |
|---|---|---|---|---|---|---|
| Set 1 | | | | | | |
| A | 1 @ 40, 500 | 30.7 | 27.0 | 1.14 | 28.9 | Jet NOT angled |
| 1 | 1 @ 40, 500 | 31.0 | 30.7 | 1.01 | 30.9 | Angled jet holes |
| Set 2 | | | | | | |
| B | 2 @ 40, 500 | 29.3 | 29.1 | 1.01 | 29.2 | Jet NOT angled |

TABLE 1-continued

| Sample | Before Belt Perturb jet # passes pres. & consol. | MD SGT, lbs. | XD SGT, lbs | MD/XD SGT | Avg. Strength, lbs | Comment |
|---|---|---|---|---|---|---|
| 2 | 2 @ 40, 500 | 27.8 | 30.1 | 0.924 | 28.9 | Angled jet holes |

In the above table, the consolidation process is shown in the second column, the first descriptor being the first jet in the consolidator-simulation (whether angled or not), and the second descriptor being the second consolidator jet, a straight (not angled) 5/40 jet or normal manufacture. (In all cases the fabric was turned over along the machine direction axis between belt and drum simulation processes to achieve the equivalent of two-sided needling and to retain the relative web motion to the jets.)

The web used had been formed on a Rando-Webber that provides relatively isotropic properties. It is postulated that the reason more improvement was not seen with this Rando-Web feedstock is that the fibers oriented in a more-or-less machine direction were perturbed towards the XD direction (as desired), but that those already-present fibers which were oriented in a more-or-less cross-machine direction were perturbed towards the MD direction, thereby lessening the overall impact. It is believed that webs with higher MD/XD inherent ratio, will yield even greater improvement, because they have more MD-oriented fibers to perturb.

EXAMPLES 3–5

Two layers of 100% polyester, 0.73 oz/yd$^2$ basis weight carded web of 1.2 dpf, 1.5 inch cut length from DuPont and carded by Hollingsworth, Inc. were used. Five samples were prepared, two being controls (C and D) with no intended fiber perturbation, and three working examples with varying degrees and methods of perturbation. The same jet profile used in Examples 1–2 was used.

In Example 4 an angled jet stream was applied after the simulated belt-needling process, but before the simulated drum-needling process. This was based on the observation of fuzziness on the bottom side of webs when they were turned over on the table washer. This indicates a high number of free ends that would be available for cross-machine perturbation after the belt washer.

An alternate method to demonstrate cross-machine fiber perturbation using a standard jet of good quality and greater holes per inch than the 10 hole/in jet described above was to use a standard jet strip (holes not angled). This is shown in Example 5. The standard jet strip was positioned in a jet housing and the housing itself is angled to the normal vertical direction and is combined with a 90° rotation of the sample on the belt. This arrangement did provide a cross-machine perturbation. It has been noted that this method can perturb the full fiber length at one time, rather than incremental fiber length perturbation available with angled jet strips.

TABLE 2

| Sample | Before Belt Perturb jet # passes, pressure and consol. | After Belt Perturb jet, # passes and consol. | MD SGT, lbs. | XD SGT lbs. | MD/XD SGT | Avg. Strength, lbs. | Comment |
|---|---|---|---|---|---|---|---|
| C | 40 hole/in 300, 500* | n.a. | 38.8 | 10.3 | 3.77 | 24.6 | 1 |
| D | 40 hole/in 2 @ 40, 500* | na. | 38.6 | 12.3 | 3.14 | 25.4 | 2 |
| 3 | 10 hole/in 2 @ 40, 500* | n.a. | 27.4 | 12.9 | 2.12 | 20.2 | 3 |
| 4 | 10 hole/in 2 @ 40, 500* | 10 hole/in. 1 @ 200 | 25.1 | 14.9 | 1.68 | 20.0 | 4 |
| 5 | 40 hole/in 2 @ 40, 500* | 40 hole/in 1 @ 160 | 23.7 | 16.9 | 1.40 | 20.3 | 5 |

*Standard 5/40 jet strip

Comment Notes:

(In all cases the fabric was turned over between belt and drum simulation processes to achieve two-sided entangling)

1. Consolidator was straight 5/40 jet with passes of 300 and 500 psi. Following consolidation, the jet profile described previously was used.
2. Same as C except first two passes of 5/40 consolidator were made at 40 psi.
3. Two consolidator passes at 40 psi were made using the angled jet strip described above, with jet holes 30° to the normal. This was followed with a 500 psi consolidator using the 5/40 straight jet, and then the jet profile described above.
4. Two consolidator passes at 40 psi were made using the angled jet strip described above, with jet holes 30° to the normal. This was followed with a 500 psi consolidator using the 5/40 straight jet, and then the jet profile for the belt process described above was used. This was followed by a pass under the 10 hole/inch angled jet strip (30° to normal), then followed with the drum jet profile.
5. Two consecutive passes at 40 psi were made using an angled jet body with a standard 5/40 jet strip with the angled jet body being perpendicular to the direction of belt travel and the sample rotated 90° to achieve simulated cross-machine perturbation. The water jet impacted the belt at a point not over a vacuum slot. The sample was then rotated back to its starting orientation and entangled with the belt process described above using non-angled jets or jet bodies. The sample was then turned over for entangelment on the other side, rotated 90° and passed under the angled jet body with 5/40 jet strip, this time at 160 psi. Then it was rotated back to its starting orientation and processed with the drum profile described above.

EXAMPLES 6–7

Samples of unconsolidated web were taken from a commercial line for making Sontara® using an air laid process. The samples had 1.35 dpf and a length of 0.8 inch. This unconsolidated web had been previously cross-lapped, and then re-air-laid, but had not been subjected to a consolidating jet of any type. This sample was cut into strips and processed in the manner described for Examples 3–5. Conditions were the same, only the feedstock was changed.

TABLE 3

| Sample | Before Belt Perturb jet # passes pressure and consol. | After Belt Perturb jet # passes and consol. | MD SGT, lbs. | XD SGT lbs. | MD/XD SGT | Avg. Strength, lbs. | Comment |
|---|---|---|---|---|---|---|---|
| E | 300, 500* | n.a. | 54.7 | 38.6 | 1.42 | 46.6 | 1 |
| F | 2 @ 40, 500* | n.a. | 52.6 | 39.6 | 1.33 | 46.1 | 2 |

TABLE 3-continued

| Sample | Before Belt Perturb jet # passes pressure and consol. | After Belt Perturb jet # passes and consol. | MD SGT, lbs. | XD SGT lbs. | MD/XD SGT | Avg. Strength, lbs. | Comment |
|---|---|---|---|---|---|---|---|
| 6 | 2 @ 40, 500* | n.a. | 48.4 | 49.0 | 0.988 | 48.7 | 3 |
| 7 | 2 @ 40, 500* | 10 hole/in 1 @ 200 | 37.3 | 53.4 | 0.699 | 45.4 | 4 |

*Standard 5/40 jet strip
Comment Notes:
1. Consolidator was straight 5/40 jet with passes of 300 and 500 psi. Following consolidation, the jet profile described above was used.
2. Same as E except first two passes of 5/40 consolidator were made at 40 psi.
3. Two consolidator passes at 40 psi were made using the angled jet strip described above, with jet holes 30° to the normal and angled to the side of the web. This was followed with a 500 psi consolidator using the 5/40 straight jet, and then the jet profile described above.
4. Two consolidator passes at 40 psi were made using the angled jet strip described above, with jet holes 30° to the normal. This was followed with a 500 psi consolidator using the 5/40 straight jet, and then the jet profile for the belt process described above was used. This was followed by a pass under the 10 hole/inch angled jet strip (30° to normal), then followed with the drum jet profile described above.
The improvement in the MD/XD ratio to less than unity is particularly noteworthy especially considering that no significant loss of average strength was seen. It is noted that for this air laid-, previously-cross-lapped web of 0.8 inch cut length, no deterioration in average strength was seen, although a very strong influence on the MD/XD ratio was effected.

EXAMPLES 8–10

It was believed that similar results would result if the fluid were directed at fiber ends (through the use of a rotated jet housing) versus directed at fiber sides through the use of angled holes in a jet strip. Below are examples demonstrating this concept. There is presented a case where the fluid was directed in the direction of product flow (that is, concurrent flow) and an example where the fluid was directed against the product flow (that is, countercurrent flow). The feed web for these examples was one layer of nominal 0.9 oz/yd$^2$ and one layer of nominal 1.2 oz/yd$^2$ carded web provided by Hollingsworth from 1.5 inch, 1.5 dpf Dacron® polyester laid together to form a web having a basis weight of 2.1 oz/yd$^2$. A "scrambler" roll was used at the Hollingsworth card exit to reduce MD/XD ratio.

All of the examples in the table immediately below were made with the perturbation stream impacting on the web from the angled jet housing at a position over a vacuum slot beneath the moving belt. Previous examples cited were prepared with the angled jet housing rotated so that the impacting stream did not fall over a vacuum slot. In all cases, however, the perturbation stream from the angled jet strip (angled holes) did fall over a vacuum slot, since this was the natural spatial relationship of the jet and slot.

The examples below were intended to more nearly represent a commercial process, where production rate was calculated to be 20 pounds of product per inch of machine width per hour, not atypical for commercial production. Belt speed was 91 ypm, versus the 40 ypm reported in earlier examples. The belt and drum processes for entangling were represented by utilizing a 5/40 jet profile with the following pressures used:

Belt: 500, 1000, 1500, 1700, 1800, 1800, 1600, 1500, 1500, 1000 (psi) for 10.4 IxE for a nominal 2.1 oz/yd$^2$ fabric.

Drum: 500, 1500, 1500, 1500, 1500, 1700, 1500, 1500, 1500, 1500 (psi) for 10.3 IxE for a nominal 2.1 oz/yd$^2$ fabric.

TABLE 4

| Sample | Before Belt Perturb jet # passes pressure and consol. | After Belt Perturb jet # passes and consol. | MD SGT, lbs. | XD SGT lbs. | MD/XD SGT | Avg. Strength, lbs. | Comment |
|---|---|---|---|---|---|---|---|
| G | 300, 500* | n.a. | 29.5 | 18.6 | 1.59 | 24.0 | 1 |
| 8 | 1 @ 40, 500* | 10 hole/in 1 @ 200 | 32.1 | 26.0 | 1.23 | 29.0 | 2 |
| 9 | 1 @ 200, 500* | N/A | 30.2 | 22.0 | 1.37 | 26.1 | 3 |
| 10 | 1 @ 40, 500* | 10 hole/in 1 @ 200 | 29.1 | 21.4 | 1.36 | 25.2 | 4 |

*Standard 5/40 jet strip
Comment Notes:
1. Consolidator was straight 5/40 jet with passes of 300, 500 psi
2. One consolidator pass at 40 psi was made using angled jet body housing (angled at 28° to vertical). This was followed with standard consolidator 5/40 at 500 psi. This was performed with perturbation flow concurrent to belt motion. After the belt washing process, the web was turned over along its major axis and subjected to angled perturbation using the 10 hole/in 30° angled jet strip detailed previously. This was followed with the drum entangling process.
3. This was the same as sample 8, except the first perturbation was at 200 psi and no perturbation was performed before the drum process. This was to demonstrate the angled jet body effect without other perturbation.
4. This was produced in the manner of sample 8 except the angled jet body provided countercurrent flow relative to belt motion.

EXAMPLES 11–16

The samples were obtained from a commercial line for making Sontara® different from the one in Examples 6–7. The samples were carded web of fibers at 1.5 dpf and 1.5 inch fiber length. However, as above, these examples were supplied as unconsolidated webs. The web was supplied as pre-cut samples of about 1 oz/yd$^2$. Two plies were layered to provide about a 2 oz/yd$^2$ web, with the individual layers both oriented in the machine direction. There were no pre-consolidating or pre-bonding of these layers. Other than the perturbing and/or consolidating jet processes shown in the table itself, each example except the first was hydroentangled with the following jet profile (using 5/40 jets. Belt speed was 40 ypm, representing about 8 pounds/in/hour:

Belt: 500, 1000, 1300, 1500, 1500, 1000, 1000 (psi)

Drum: 500, 1500, 1500, 1500, 1500, 1000 (psi)

TABLE 5

| Sample | Before Belt Perturb jet # passes pressure and consol. | After Belt Perturb jet # passes and consol. | MD SGT, lbs. | XD SGT lbs. | MD/XD SGT | Avg. Strength, lbs. | Comment |
|---|---|---|---|---|---|---|---|
| H | No perturb 300, 500 | n.a. | 5.1 | 1.5 | 3.40 | 3.3 | 1 |
| I | No perturb 300, 500 | n.a. | 41.4 | 22.9 | 1.81 | 32.1 | 2 |
| Used slant jet with angled HOLES | | | | | | | |
| 11 | 2 @ 40 pert. 500 | n.a. | 38.8 | 30.5 | 1.27 | 34.6 | 3 |
| 12 | 2 @ 40 pert. 500 | 1 @ 200 slant holes | 33.6 | 29.1 | 1.15 | 31.3 | 4 |

TABLE 5-continued

| Sample | Before Belt Perturb jet # passes pressure and consol. | After Belt Perturb jet # passes and consol. | MD SGT, lbs. | XD SGT lbs. | MD/XD SGT | Avg. Strength, lbs. | Comment |
|---|---|---|---|---|---|---|---|
| 13 | 2 @ 40 pert. 300, 500 | 1 @ 200 slant holes | 37.8 | 32.8 | 1.15 | 35.3 | 5 |
| Used rotated jet housing | | | | | | | |
| 14 | 1 @ 100 pert. 300, 500 | n.a. | 36.2 | 29.5 | 1.23 | 32.8 | 6 |
| 15 | 1 @ 200 pert. 300, 500 | n.a. | 36.4 | 29.3 | 1.24 | 32.8 | 7 |
| 16 | 1 @ 100 pert. 300, 500 | 1 @ 200 slant holes | 37.8 | 30.2 | 1.25 | 34.0 | 8 |

Comment Notes:
1. Prepared using standard consolidator jets only, with no belt or drum process following. This was to assess the strength contribution from these jets used early in the Sontara ® process. In some examples, some loss of overall strength has been seen when one consolidating jet was sacrificed and substituted with an angled jet. This data, along with a comparison of samples 12 and 13 above indicate better strength performance may be had with the addition of art angled jet to an existing number of consolidators, rather than substituting for a consolidator.
2. Two consolidator jet passes of 300 and 500 psi, using a standard 5/40 jet, followed by the profile listed before Table 5.
3. Two passes at 40 psi on slant jet with 10 holes/inch (13.5 mils) over a vacuum slot followed by a consolidator at 500 psi using a 5/40 jet.
4. Sample 12 was prepared as sample 11, but in addition included fiber perturbation after the belt and before the drum process, using 1 pass at 200 psi with the angled hole jet with 10 holes/inch.
5. Sample 13 was prepared like sample 12, but with the addition of a consolidator jet at 300, giving consolidator pressures of 300 and 500 psi. MD/XD ratio was reduced to 1.15 and average strength was improved over control, even at somewhat lower basis weight (1.72 vs. 1.86 oz/yd$^2$). This confirms that better performance may be had with the addition of fiber perturbation, but without sacrificing consolidator jets which contribute a not insignificant fabric strength.
6. Sample 14 was prepared with one pass at 100 psi using 30° angled jet housing, followed by consolidation at 300 and 500 psi with normal 5/40 jet. No perturbation was done after belt.
7. Sample 15 was prepared as 14, but using 200 psi for the perturbing pressure. All else was the same.
8. Sample 16 was prepared as 14, but using one pass at 200 psi between the belt and drum, using the 10 hole/inch angled jet strip.
In general these data show that with unconsolidated web, the MD/XD ratio was reduced from 1.81 to 1.15 using angled jet hole technology, and to 1.25 using angled jet housing technology.

EXAMPLE 17

Besides the types of fabrics mentioned above, there are also fabrics compose of combinations of synthetic fibers such as polyester and short, natural fibers, such as woodpulp. It is demonstrated in the example below that the inventive feature of fiber perturbation applies to those fabrics as well. Examples shown were composed of a nominal 1.2 oz/yd$^2$ carded polyester web with 1.5 dpf and 1.5 inch fiber length topped with paper made of pine woodpulp. The control was formed by hydroentangling these two materials together at a speed and jet profile similar to that used to produce Sontara® 8801, wherein all hydroentangling is directed onto the paper ( i.e., wood pulp) side and no fiber perturbation is introduced. The inventive example utilized the same web and same jet profile except that concurrent fiber perturbation was introduced using the angled jet housing containing a standard 5/40 jet strip with the perturbing jet stream impinging on the product while it was above a vacuum slot.

The examples immediately below were intended to represent a commercial process, where production rate was calculated to be 40 pound of product per inch of machine width per hour, not atypical for commercial production of a 2 oz/yd$^2$ product of woodpulp and polyester. Belt speed was 192 ypm, versus the 40 and 91 ypm reported in earlier examples. The belt process for entangling utilized a 5/40 jet profile with the following pressure used:

Belt: 300, 600, 1000, 1000, 1500, 1800, 1800, 1800, 1800, 300 (psi)

TABLE 6

| Sample | Before Belt Perturb jet # passes pressure and consol. | After Belt Perturb jet # passes and consol. | MD SGT, lbs. | XD SGT lbs. | MD/XD SGT | Avg. Strength, lbs. | Comment |
|---|---|---|---|---|---|---|---|
| J | 160, 300* | n.a. | 39.1 | 23.2 | 1.68 | 31.2 | 1 |
| 17 | 1 @ 160, 300* | n.a. | 34.2 | 28.2 | 1.21 | 31.2 | 2 |

Comment Notes:
1. Consolidator was straight 5/40 jet with passes of 160, 300 psi
2. One consolidator pass at 160 psi was made using angled jet body housing (angled at 28° to vertical). This was followed with standard consolidator 5/40 at 300 psi. This was performed with perturbation flow concurrent to belt motion. In this example, perturbing jet fluid impinged the web above a vacuum slot.

EXAMPLES 18–22

These examples are of 100% polyester and demonstrate the effect of perturbing pressure on isotropy. An angled jet (5 mil/40 holes per inch/30°) was joined to sacrificial jet strips to fit full size machines. The holes were angled to the side of the web. The webs were made at a speed of 82 ypm. The control samples utilized two consolidator jets at 300 and 400 psi. The working examples had segmented angled jet strip in the No. 1 consolidator position at the pressures indicated in the table and with the No. 2 consolidator at 500 psi.

TABLE 7

| Example | K | 18 | 19 | 20 | 21 | 22 |
|---|---|---|---|---|---|---|
| Perturb Condition | 40 psi straight | 40 psi angled | 60 psi angled | 75 psi angled | 110 psi angled | 150 psi angled |
| MD SGT | 55.2 | 53.1 | 55.0 | 51.1 | 49.6 | 39.4 |
| XD SGT | 25.3 | 34.9 | 30.0 | 34.3 | 34.6 | 36.6 |
| MD/XD | 2.18 | 1.52 | 1.83 | 1.49 | 1.43 | 1.07 |
| Avg. SGT | 40.2 | 44.0 | 42.4 | 42.7 | 42.1 | 38.0 |
| Uniform. | 1 | 1 | 1.5 | 4 | 5 | 5 |

The data in the table above show the inventive process was successful in reducing the MD/XD SGT ratio, primarily through an increase in XD strength rather than a loss in MD strength. Relatively low pressures were sufficient to achieve good MD/XD results. High pressures also achieved good MD/XD results, but tended to cause jet washing that resulted in less fabric uniformity. Uniformity was rated visually on a scale of 1–5, with 1 as the best.

EXAMPLES 23–28

The examples below demonstrate the effect of variation in the perturbing jet angle on MD/XD isotropy. These examples were made from unconsolidated web of 1.5 dpf, 1.5 inch 100% polyester. The examples were formed on a table washer using a standard (non-angled 5/40 jet strip). The various angles were achieved by mounting the jet housing in angled brackets manufactured to provide angles from 5° to 50° from the perpendicular, such that the curtain was directed to the trailing ends of the fibers. To more nearly simulate the perturbing action which a jet would provide with angled holes, the web was rotated 45° on the belt before passing under the perturbing jet. After the first pass for perturbation, the web was re-oriented to its normal position and hydroentangled with the following jet profile: 300, 500, 500, 1000, 1300, 1500, 1500, 1000, 1000 psi provided by a straight 5/40 jet.

TABLE 8

| Example | L | 23 | 24 | 25 | 26 | 27 | 28 |
|---|---|---|---|---|---|---|---|
| Angle | | 5° | 10° | 20° | 30° | 40° | 50° |
| MD SGT | 35.8 | 34.0 | 29.8 | 31.8 | 31.4 | 30.6 | 23.9 |
| XD SGT | 17.7 | 16.9 | 19.8 | 23.6 | 22.9 | 19.9 | 15.1 |
| MD/XD | 2.02 | 2.01 | 1.50 | 1.35 | 1.37 | 1.54 | 1.58 |
| Avg. SGT | 26.8 | 25.6 | 24.8 | 27.7 | 27.2 | 25.2 | 19.5 |

The entire range of angles considered provided increased isotropy over the control.

EXAMPLES 29–32

These examples demonstrate the inventive process on full-size, commercial equipment at full line speeds.

A jet strip was used measuring 146.16" long by 0.5" wide, having 40 holes per inch of 0.005" diameter angled 30° from normal and directed to a side of the web. The jet strip was mounted above a vacuum slot. The product produced was a woodpulp/polyester blend of 55%/45% by weight, non-patterned and squeeze-roll dewatered. The fiber used was 1.5 inch, 1.5 denier Dacron® and the paper was pine-based, NSK 29.75 lb./ream, white in color. The jet profile, shown below in Table 9 remained constant for the test with the exception of the pressure on the angled jet and the vacuum beneath that particular jet.

TABLE 9

| Jet Position | Jet Type | Pressure, bar |
|---|---|---|
| Perturbing jet | 5/40/30° angled | |
| Consolidator 1 | 5/40 | 28 |
| Consolidator 2 | 5/40 | 41 |
| Paper consolidator | 5/40 | 20 |
| Belt washer 1 | 5/40 | 21 |
| Belt washer 2 | 5/40 | 28 |
| Belt washer 3 | 5/40 | 48 |
| Belt washer 4 | 5/40 | 69 |
| Belt washer 5 | 5/40 | Off |
| Belt washer 6 | 5/40 | 103 |
| Belt washer 7 | 5/40 | 103 |
| Belt washer 8 | 5/40 | 124 |
| Belt washer 9 | 5/60 | 103 |

A control sample was first made with no perturbing jet turned on and no vacuum under it. The working examples were made with the perturbing jets at the pressures and vacuum conditions as provided in the table below The data are presented immediately below.

TABLE 10

| Example | M | 29 | 30 | 31 | 32 |
|---|---|---|---|---|---|
| Pressure (bar) | n.a. | 5 | 4 | 5 | 4 |
| Vacuum (in) | n.a. | 2 | 2 | 0.5 | 0.5 |
| Property | | | | | |
| B.W. g/m$^2$ | 70.5 | 67.6 | 67.5 | 67.9 | 68.5 |
| Thickness mm | 0.40 | 0.40 | 0.38 | 0.40 | 0.40 |
| XD SGT, N | 76.4 | 87.8 | 83.9 | 92.8 | 91.4 |
| MD % Elon | 113 | 84.7 | 91.7 | 84.8 | 77.1 |
| MD SGT N | 177 | 155 | 162 | 165 | 153 |
| XD % Elon | 18.8 | 26.4 | 23.7 | 25.4 | 27.6 |
| (MD + XD)/2 | 126 | 121 | 123 | 129 | 122.2 |
| MD/XD Ratio | 2.31 | 1.76 | 1.93 | 1.78 | 1.67 |

n.a. - Not applicable N = Newtons

The data showed desired improvement in cross machine (XD) strength and improvement in isotropy (MD/XD ratio).

EXAMPLES 33–41

Some examples, whether representing single or double row perturbation, were simulated with single row jet(s). However, it was determined that use of a jet strip having two or more rows of holes would permit the curtains to have a variety of angles and directions without the need to angle the jet housing, which is particularly relevant for a full scale commercial line.

To that end, examples below were prepared using a jet strip as generally depicted in FIG. 1 except that the strip had two rows of holes. Using FIGS. 5–6 as a reference, for each curtain, $\theta_1$ and $\theta_2$ were each at 30°. Further, and with reference to FIG. 6, the curtains were opposed to one another, i.e., splayed such that $\theta_3$ was 10°. Line speed was 75 ypm in all cases.

The unconsolidated web was made from 1.5 dpf 100% polyester, 1.5 inch fibers. The vacuum beneath jet was 4–5 inches of $H_2O$. All entanglement was with 5/40 jets; consolidator pressure for control was 300, 500(psi); belt profile was 500, 1000, 1500, 1700, 1800, 1800, 1600, 1500, 1500, 1500 (psi); and drum profile was 500, 1500, 1500, 1500, 1500, 1700, 1700, 1500, 1500, 1500 (psi).

TABLE 11

| Example | N | 33 | 34 | 35 | 36 | 37 | 38 | 39 | 40 | 41 |
|---|---|---|---|---|---|---|---|---|---|---|
| Perturb psi | 0 | 10 | 20 | 30 | 45 | 65 | 85 | 100 | 140 | 180 |
| MD SGT, lbs. | 38.9 | 38.8 | 40.1 | 36.1 | 32.2 | 30.9 | 31.9 | 27.8 | 25.7 | 24.3 |
| XD SGT, lbs. | 16.3 | 17.2 | 18.2 | 21.7 | 23.0 | 21.5 | 22.3 | 20.6 | 18.9 | 18.0 |
| MD, % E | 79.6 | 78.1 | 77.7 | 73.3 | 80.7 | 79.9 | 83.5 | 76.8 | 75.5 | 73.3 |

TABLE 11-continued

| Example | N | 33 | 34 | 35 | 36 | 37 | 38 | 39 | 40 | 41 |
|---|---|---|---|---|---|---|---|---|---|---|
| XD, % E | 125.3 | 133.3 | 135.6 | 135.7 | 134.2 | 127.3 | 130.9 | 138.8 | 139.3 | 126.6 |
| BW, oz/yd$^2$ | 2.00 | 2.11 | 2.06 | 2.03 | 2.06 | 2.06 | 2.05 | 2.04 | 2.00 | 1.98 |
| MD/XD SGT | 2.39 | 2.25 | 2.20 | 1.66 | 1.40 | 1.44 | 1.43 | 1.35 | 1.36 | 1.35 |
| Avg SGT, lbs | 27.6 | 28.0 | 29.1 | 28.9 | 27.6 | 26.2 | 27.1 | 24.2 | 22.3 | 21.2 |
| Unif. | 1 | 1 | 1 | 1 | 1 | 1 | 2 | 3 | 4 | 5 |

Uniformity (Unif) was rated visually on a scale of 1–5, with 1 as the best.

EXAMPLE 42

Improved opacity was observed during trials on full commercial scale as described in the Examples above when a portion of a full width web was subjected to the perturbing operation and, especially where the perturbed web represented a portion of the full width web, and another portion of the web was not perturbed and the differences could be observed in real time. The improvement was measured by comparing the opacity of a control sample and a test sample using TAPPI method T-425. TAPPI is the Technical Association of Pulp and Paper Industries. The instrument used was a Macbeth Color-Eye colorimeter, model 7000A. The control N and the example 36 from Table 10 above showed an opacity of 51.21 and 53.89, respectively. This difference of 2.67% in opacity represents a significant improvement and is readily visible to the naked eye.

What is claimed is:

1. A method for changing the orientation of fibers in a nonwoven web produced by hydroentangling wherein a portion of the fibers are oriented in substantially the machine direction and a portion of the fibers are oriented in substantially the cross-machine direction comprising the steps of (a) providing a first plurality of fluid jets offset at an appreciable angle from the perpendicular with respect to the web, (b) applying a plurality of fluid streams from the jets of step (a) onto a surface of the nonwoven web at a pressure sufficient to move the fibers into a different position wherein the streams form a substantially coplanar curtain, (c) providing a first plurality of nonangled fluid jets, (d) applying a first plurality of fluid streams from the first plurality of nonangled jets onto the nonwoven web of step (b), wherein the streams form a substantially coplanar curtain (e) providing a second plurality of fluid jets offset at an appreciable angle from the perpendicular with respect to the web, (f) applying a plurality of fluid streams from the jets of step (e) onto the nonwoven web of step (d) at a pressure sufficient to move the fibers into a different position wherein the streams form a substantially coplanar curtain, (g) providing a second plurality of nonangled jets, (h) applying a plurality of fluid streams from the second plurality of nonangled jets onto the nonwoven web of step (f), wherein the streams form a substantially coplanar curtain.

* * * * *